US012123431B1

(12) United States Patent
Tan et al.

(10) Patent No.: US 12,123,431 B1
(45) Date of Patent: Oct. 22, 2024

(54) FAN STRUCTURE

(71) Applicant: ASIA VITAL COMPONENTS (CHINA) CO., LTD., Shenzhen (CN)

(72) Inventors: Ze-Hua Tan, Shenzhen (CN); Hua Lai, Shenzhen (CN)

(73) Assignee: ASIA VITAL COMPONENTS (CHINA) CO., LTD., Shenzhen (CN)

( * ) Notice: Subject to any disclaimer, the term of this patent is extended or adjusted under 35 U.S.C. 154(b) by 0 days.

(21) Appl. No.: 18/600,896

(22) Filed: Mar. 11, 2024

(30) Foreign Application Priority Data

Feb. 27, 2024 (TW) ..... 113107093

(51) Int. Cl.
*F04D 29/52* (2006.01)
*F04D 19/00* (2006.01)

(52) U.S. Cl.
CPC ..... *F04D 29/522* (2013.01); *F04D 19/002* (2013.01)

(58) Field of Classification Search
CPC ..... F04D 19/002; F04D 29/522
See application file for complete search history.

(56) References Cited

U.S. PATENT DOCUMENTS 9,234,521 B2 * 1/2016 Liu ..... F04D 29/164
11,339,793 B2 * 5/2022 Aiello ..... F04D 1/10

* cited by examiner

*Primary Examiner* — Christopher R Legendre
(74) *Attorney, Agent, or Firm* — Demian K. Jackson; Jackson IPG PLLC

(57) ABSTRACT

A fan structure includes an upper frame defining a receiving space and at least one recess communicable with the receiving space; a stationary blade frame connected to a lower side of the upper frame, and internally forming a flared air passage having a stator seat provided therein; and an annular impeller externally provided with at least one inclined section corresponding to the recess. The annular impeller is mounted on the stator seat and located in the receiving space of the upper frame, and includes a hub, a plurality of blades, and an annular member. An impeller air passage is defined between the hub and the annular member and is communicable with the flared air passage to together form an inner airflow path. An outer side passage leading to the inclined section is defined between the annular member and the at least one recess to form an outer airflow path.

6 Claims, 7 Drawing Sheets

FAN STRUCTURE

This application claims the priority benefit of Taiwan patent application number 113107093 filed on Feb. 27, 2024.

FIELD OF THE INVENTION

The present invention relates to the field of fans, and more particularly, to a fan structure that is suitable for use in both a backpressure free state and a backpressure increased state, or for use in different states from a zero backpressure state to a state having a certain degree of backpressure.

BACKGROUND OF THE INVENTION

Following the constant progress in the scientific and technological field, people rely on various electronic devices more and more. However, electronic elements in these advanced electronic devices, such as computers, notebook computers, etc., generate a large amount of heat during their operation. The generated heat must be timely removed from the electronic devices to avoid the problem of overheating. Therefore, most of the electronic devices have a fan provided therewith, so that the electronic devices can always operate within a safe operating temperature range.

Please refer to FIGS. 1A and 1B, in which an example of prior art fan structure 1 disclosed in China Patent App. No. 201220169178.5 is shown. The fan structure 1 includes a frame 10, an impeller 11 and at least one pressure relief section 12. The impeller 11 includes a hub 111 and a plurality of blades 112. An annular member 113 is connected to radially outer ends of the blades 112 and is externally provided with a stop portion 1131 and an inclined portion 1132. The inclined portion 1132 extends slantly upward from an upper end of the annular member 113 in a direction opposing the hub 111.

The frame 10 has an air inlet 101 and an air outlet 102, and internally defines a receiving space 103, and the at least one pressure relief section 12 is provided on the frame 10. The air inlet 101 and the air outlet 102 are communicable with the receiving space 103. The air inlet 101 is provided along an inner edge with an extension portion 1031, which extends slantly downward into the receiving space 103. The air outlet 102 is formed along an inner side with at least one projected portion 1032, which extends slantly upward into the receiving space 103. And, each pressure relief section 12 transversely extends through the frame 10 in a thickness direction thereof to form a flow guiding passage 120.

The impeller 11 is received in the receiving space 103 of the frame 10, such that the extension portion 1031 of the frame 10 and the inclined portion 1132 on the annular member 113 of the impeller 11 correspondingly join with each other, and the projected portion 1032 of the frame 10 is correspondingly facing toward but spaced from the stop portion 1131 on the annular member 113 of the impeller 11. The stop portion 1131 and the projected portion 1032 are configured as a loose-fit groove and tongue joint, such that a winding passage 150 is formed between them. The flow guiding passage 120 of the pressure relief section 12 is communicable with the receiving space 103 and the winding passage 150.

When the above prior art fan structure 1 operates in a backpressure-free state (i.e. a free state, in which the air resistance or pressure to be overcome by the impeller 11 during rotating is relatively small) or in a backpressure increased state (i.e. a state in which the air resistance or pressure to be overcome by the impeller 11 during rotating is relatively large), air is guided to flow into the air inlet 101 and then flows out of the fan structure 1 via the air outlet 102. When the air is guided out of the fan structure 1, an amount of backflow air 140 is formed at the air outlet 102 at the same time. The backflow air 140 first flows through the winding passage 150 defined by between the stop portion 1131 and the projected portion 1032, and then flows through the flow guiding passage 120 of the pressure relief section 12 extended through the frame 10 in a thickness direction thereof to an outer side of the frame 10. Further, a part of the backflow air 140 passing through the winding passage 150 would flow upward along a gap 160 formed between the frame 10 and the impeller 11 but is stopped by the joined extension portion 1031 and inclined portion 1132. Therefore, the backflow air could not flow back to the air inlet 101 and would not interfere with the air flows into the air inlet 101.

No matter the prior art fan structure 1 is operating in the free state or in the backpressure increased state, the air flows through the fan structure 1 in the same direction in these two states. As a result, air externally surrounding the frame 10 can not be guided into the air inlet 101 when the fan structure 1 operates in the free state; and air in the fan structure 1 escaped to the air inlet 101 can not be guided into the gap 160 between the frame 10 and the impeller 11 but to flow to the external environment outside the fan structure 1 when the backpressure increases. In this case, the amount of air that can flow into the air inlet 101 is reversely influenced. That is, no matter the prior art fan structure 1 is operating in the backpressure free state or in the backpressure increased state, a total amount of airflow that can flow out of the air outlet 102 is largely reduced to result in poor heat dissipation efficiency of the fan structure 1.

It is therefore tried by the inventor to develop an improved fan structure to overcome the problem and disadvantage in the prior art fan structure.

SUMMARY OF THE INVENTION

A primary object of the present invention is to provide an improved fan structure that overcomes the problems in the conventional fan structure.

To achieve the above and other objects, the fan structure according to the present invention includes an upper frame, a stationary blade frame, and an annular impeller.

The upper frame has an upper-frame top portion, an upper-frame bottom portion, and an upper-frame wall portion internally defining a receiving space. The upper-frame wall portion is provided on an inner side at positions corresponding to four corners of the upper-frame top portion with at least one radially outward recess, which is communicable with the receiving space.

The stationary blade frame is connected to a lower side of the upper frame and including a top portion, a bottom portion, a flared air passage, at least one inclined section, and a stator seat. The flared air passage is conical in shape and has a diametrical size increasing gradually from the top portion toward the bottom portion of the stationary blade frame and is enclosed in an air passage wall surface. The at least one inclined section is located radially and respectively each inset from four corners of the stationary blade frame corresponding to the at least one recess formed on the inner side of the upper-frame wall portion and is radially outward and downward inclined from the top portion to the bottom portion of the stationary blade frame. The top portion of the stationary blade frame is connected to the upper-frame bottom portion end to end and has a stationary-blade-frame inlet and an upward flange extending around an outer periphery of the stationary-blade-frame inlet. The stator seat is located in the flared air passage and has a shaft barrel provided thereon.

The annular impeller is located in the receiving space of the upper frame and rotatably connected to the shaft barrel of the stationary blade frame and accordingly, located above the stator seat. The annular impeller includes a hub having a plurality of blades spaced on a circumferential outer surface thereof, and an annular member connected to radially outer ends of the blades. The annular member has a lower rim facing toward but spaced from the upward flange formed around the stationary-blade-frame inlet, such that a middle gap is defined between the lower rim of the annular member and the upward flange around the stationary-blade-frame inlet. The hub and the annular member together define between them an impeller air passage; and the impeller air passage and the flared air passage of the stationary blade frame are communicable with each other to form an inner airflow path. The impeller member has an outer circumferential surface facing toward but spaced from the inner side of the upper-frame wall portion, such that an outer side passage is defined between the annular member of the annular impeller and the at least one recess of the upper frame. The outer side passage is located in the receiving space outside the impeller air passage; and the outer side passage and the at least one inclined section of the stationary blade frame together form an outer airflow path that leads to an external environment. Further, the outer airflow path is communicable with the inner airflow path via the middle gap.

When the fan structure of the present invention with the above arrangements is operating in a free or backpressure free state, external air surrounding the stationary blade frame can be guided into the air passages in the fan via the outer airflow path to increase the quantity of airflow flowing out of the fan. When the backpressure increases, a part of the air escapes from a position near the upper-frame air inlet and another part of the air leaks from the air passages in the fan into the outer airflow path and flows to the external environment outside the stationary blade frame. In this way, air would not gather in the fan to cause airflow disturbance to thereby enable reduced noises. Or, when the backpressure increases from zero to a certain degree, the airflow in the outer airflow path no longer flows toward the upper-frame air inlet but flows out of the fan structure into external environment.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof.

Figure 1A:
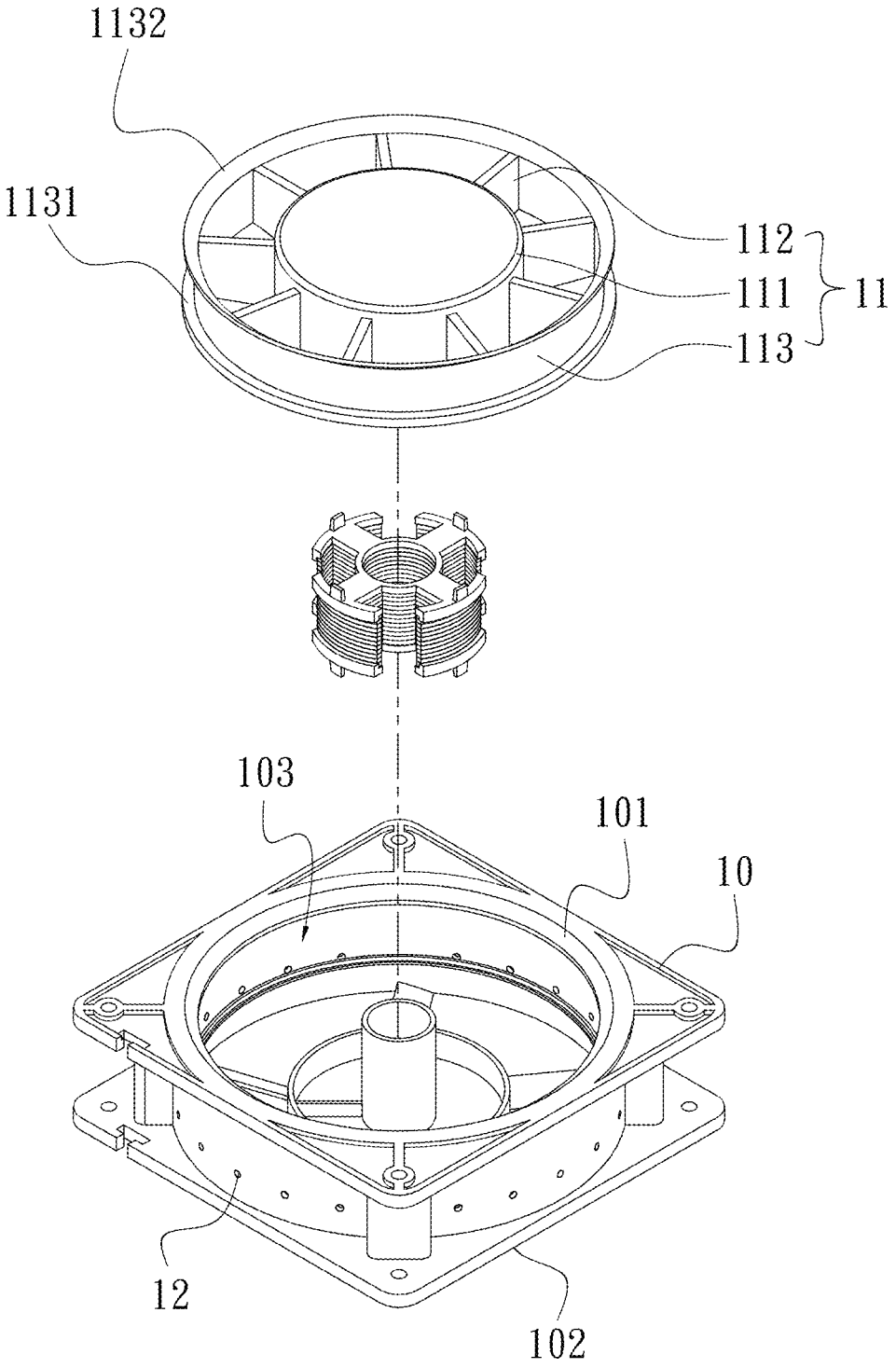
(PRIOR ART) Fig. 1A
FIG. 1A is an exploded perspective view of a conventional annular fan structure.
Figure 1B:
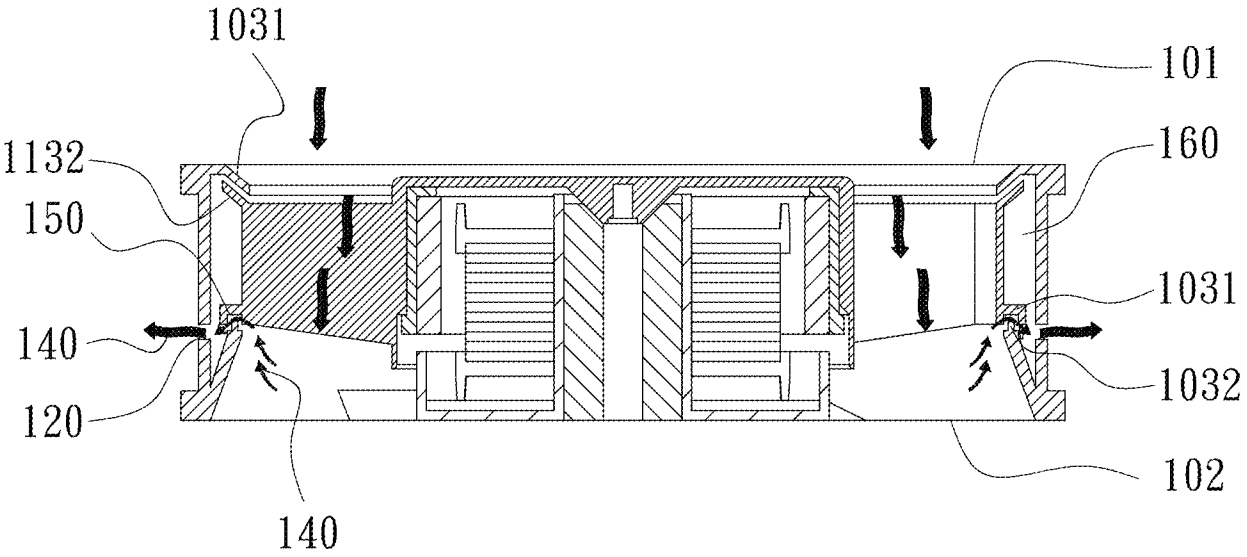
(PRIOR ART) Fig. 1B
FIG. 1B is an assembled sectional side view of the conventional annular fan of FIG. 1A in use.
Figure 2A:
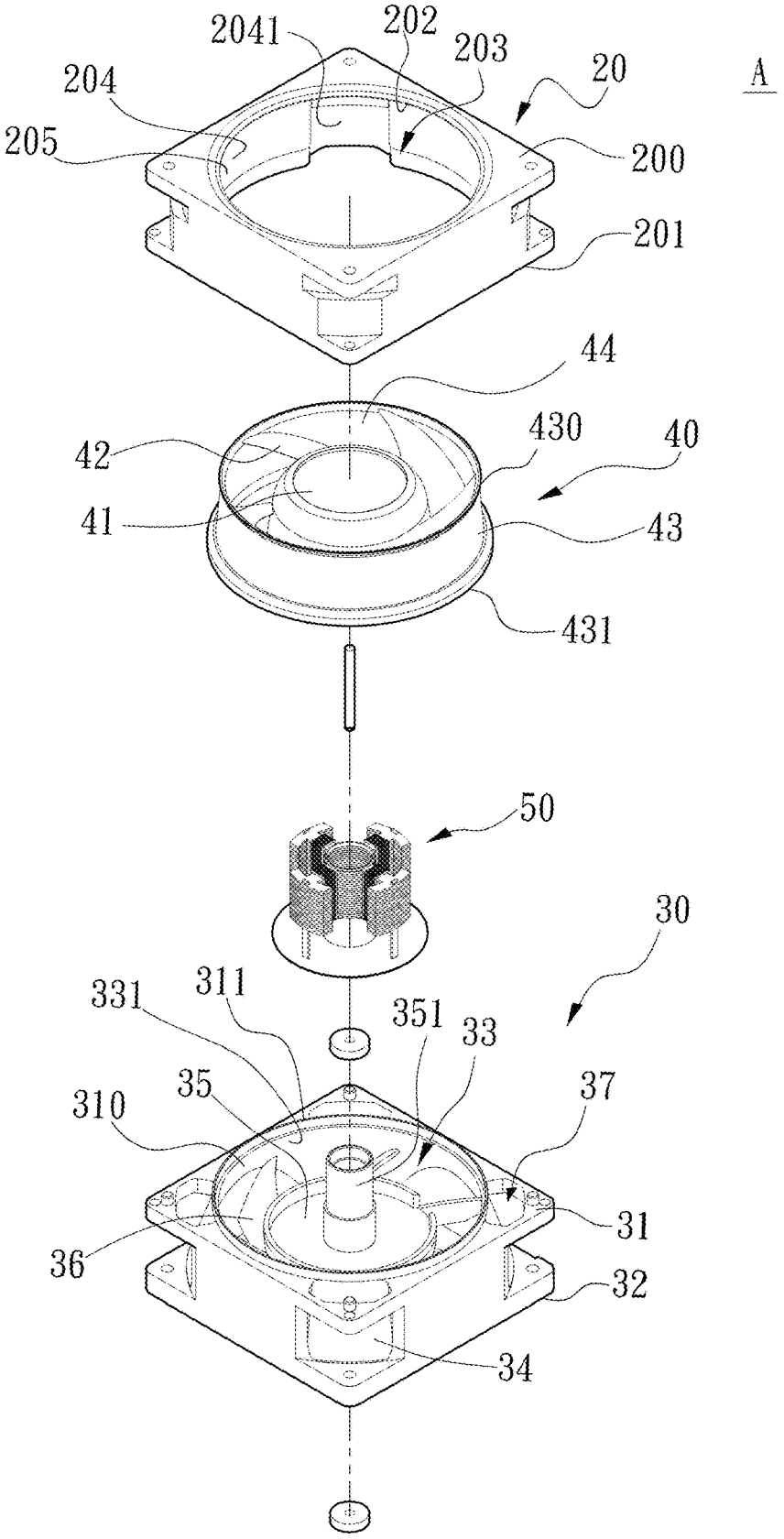
FIG. 2A is an exploded perspective view of a fan structure according to a preferred embodiment of the present invention.
Figure 2B:
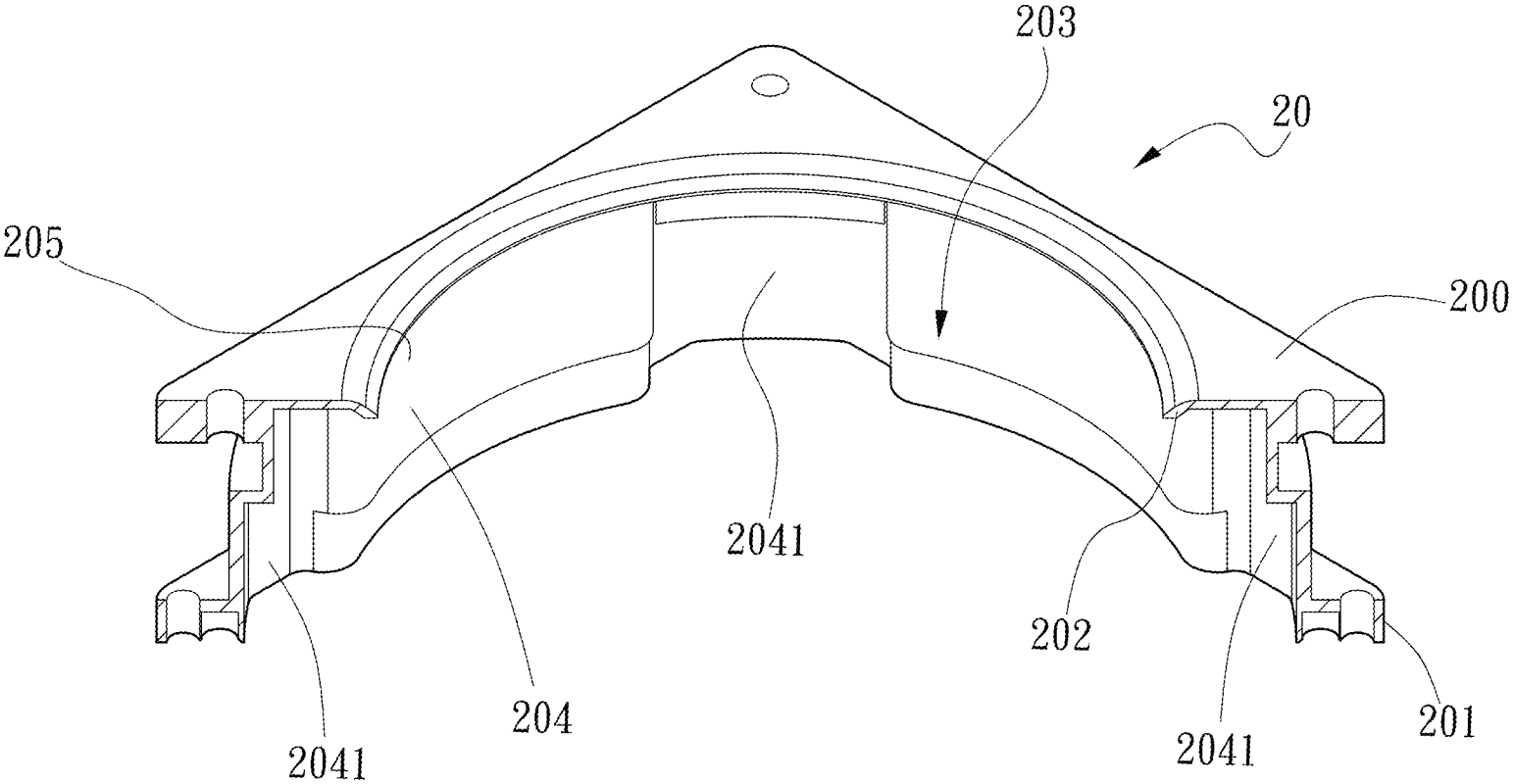
FIG. 2B is a cutaway view of an upper frame of the fan structure of FIG. 2A.
Figure 3:
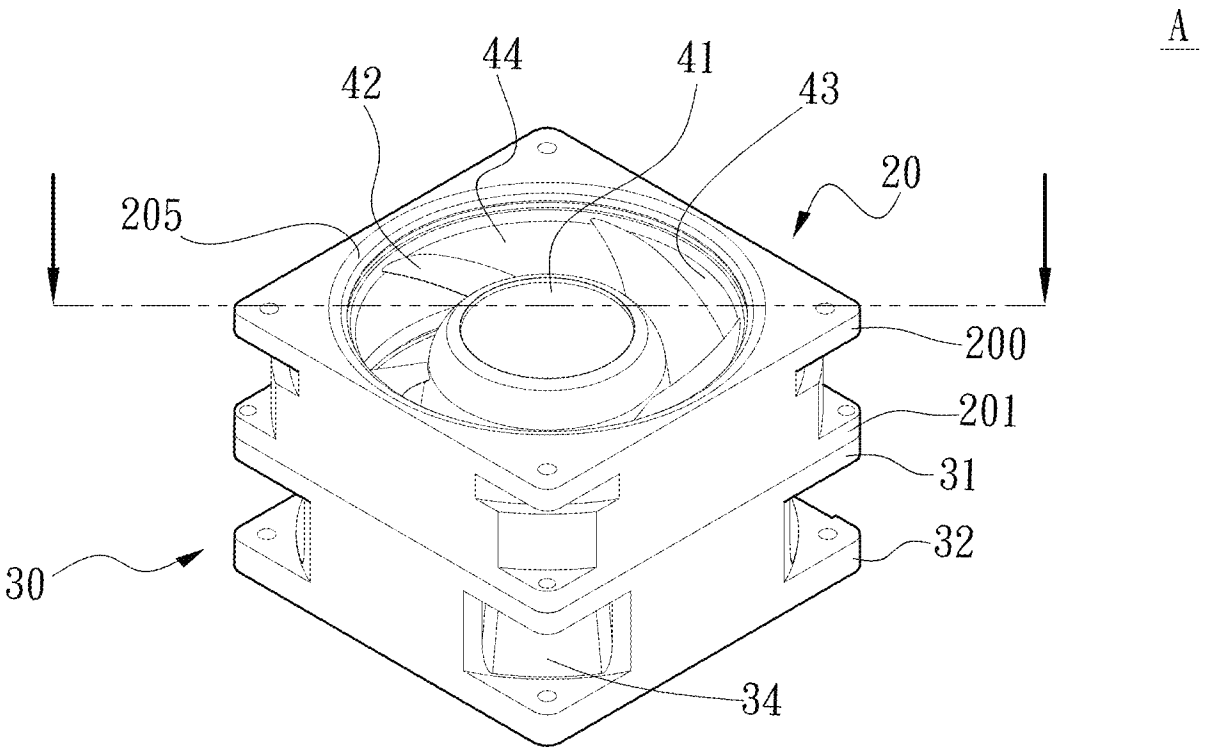
FIG. 3 is an assembled perspective view of the fan structure according to the preferred embodiment of the present invention.

Please refer to FIG. 2A, which is an exploded perspective view of a fan structure A according to a preferred embodiment of the present invention; to FIG. 2B, which is a cutaway view of an upper frame 20 of the fan structure A of FIG. 2A; and to FIG. 3, which is an assembled perspective view of the fan structure A according to the preferred embodiment of the present invention. As shown, the fan structure A includes an upper frame 20, a stationary blade frame 30, and an annular impeller 40. The upper frame 20 includes an upper-frame top portion 200, an upper-frame bottom portion 201, and an upper-frame wall portion 204. The upper-frame wall portion 204 internally defines a receiving space 203, which extends through the upper-frame top portion 200 and the upper-frame bottom portion 201. The upper-frame wall portion 204 is provided on an inner side at positions corresponding to four corners of the upper-frame top portion 200 with at least one recess 2041, which is communicable with the receiving space 203. Further, the upper-frame top portion 200 has an upper-frame air inlet 205, and a sloping downward guide brim portion 202 is formed around the upper-frame air inlet 205 to extend radially inward toward the receiving space 203. The stationary blade frame 30 is connected to a lower side of the upper frame 20 by way of fitting, locking, gluing, snapping or fastening. The stationary blade frame 30 includes a top portion 31, a bottom portion 32, a flared air passage 33, at least one inclined section 34, and a stator seat 35. The flared air passage 33 is conical in shape and has a diametrical size increasing gradually from the top portion 31 toward the bottom portion 32 of the stationary blade frame 30 to define a stationary-blade-frame inlet 310 and a stationary-blade-frame outlet 320 at the top portion 31 and the bottom portion 32 of the stationary blade frame 30, respectively. Further, the flared air passage 33 includes an air passage wall surface 331, which extends slantly from the top portion 31 to the bottom portion 32 of the stationary blade frame 30. With the downward flared air passage 33, the stationary-blade-frame inlet 310 has a cross-sectional area smaller than that of the stationary-blade-frame outlet 320. The stator seat 35 has an outer periphery connected to the air passage wall surface 331 via a plurality of stationary blades 36 and is therefore located at a center of the flared air passage 33 for a motor stator 50 to mount thereon. The stator seat 35 includes a shaft barrel 351 upward projecting toward the upper frame 20. In the illustrated preferred embodiment, the shaft barrel 351 extends through the stationary-blade-frame inlet 310 at the top portion 31 of the stationary blade frame 30 to protrude into the receiving space 203 of the upper frame 20. The shaft barrel 351 internally receives at least one bearing and the motor stator 50 on the stator seat 35 is externally fitted on around the shaft barrel 351. The at least one inclined section 34 is located outside the four corners of the stationary blade frame 30 corresponding to the at least one recess 2041 formed on the inner side of the upper-frame wall portion 204, and is radially outward and downward inclined from the top portion 31 to the bottom portion 32 of the stationary blade frame 30.

The top portion 31 of the stationary blade frame 30 is connected to the upper-frame bottom portion 201 end to end, and is provided along the stationary-blade-frame inlet 310 with an upward flange 311 projected toward the upper frame 20. At least one through bore 37 is provided on the top portion 31 of the stationary blade frame 30 at positions corresponding to the at least one recess 2041 on the inner side of the upper frame wall portion and the at least one inclined section 34 on the stationary blade frame 30. The through bore 37 is located outside the upward flange 311 and leads to an external environment outside the stationary blade frame 30. In the illustrated preferred embodiment, there is one through bore 37 provided at each of four corners of the top portion 31 of the stationary blade frame 30 and communicating with the external environment via the inclined sections 34.

The annular impeller 40 includes a hub 41, a plurality of blades 42 spaced on a circumferential outer surface of the hub 41, and an annular member 43 connected to radially outer ends of the blades 42. The hub 41 internally has a center shaft rotatably connected to the at least one bearing in the shaft barrel 351, so that the hub 41 is rotatably connected to the shaft barrel 351 and mounted on the stator seat 35 and located in the receiving space 203 of the upper frame 20. An impeller air passage 44 is defined between the hub 41 and the annular member 43, such that the annular member 43 is located corresponding to the upward flange 311 formed around the stationary-blade-frame inlet 310 and the impeller air passage 44 is located above the flared air passage 33 of the stationary blade frame 30 and below the upper-frame air inlet 205, i.e. the upper-frame air inlet 205 is located above the impeller air passage 44. Therefore, the impeller air passage 44 and the flared air passage 33 are communicable with each other to form an inner airflow path.

With the annular impeller 40 located in the receiving space 203 of the upper frame 20, the annular member 43 of the annular impeller 40 has an outer side facing toward the inner side of the upper-frame wall portion 204, such that an outer side passage 215 is defined between the annular member 43 and the at least one recess 2041 formed on the inner side of the upper-frame wall portion 204. The outer side passage 215 is located in the receiving space 203 outside the impeller air passage 44. The outer side passage 215 together with the at least one inclined section 34 of the stationary blade frame 30 form an outer airflow path that leads to an external environment. Further, the outer side passage 215 is communicable with the at least one inclined section 34 via the at least one through bore 37 on the top portion 31 of the stationary blade frame 30.

The annular member 43 has an upper rim 430 and a lower rim 431. The upper rim 430 of the annular member 43 is located at the same side as the upper-frame top portion 200 to face toward and space from the sloping downward guide brim portion 202 formed around the upper-frame air inlet 205, such that an upper gap 232 is formed between a free end 2021 of the guide brim portion 202 and the upper rim 430 of the annular member 43. The lower rim 431 of the annular member 43 is located at the same side as the upper-frame bottom portion 201, and is provided with a downward opened annular groove 433. The downward opened annular groove 433 and the upward flange 311 around the inlet 310 of the stationary blade frame 30 are correspondingly configured for joining with each other loosely with a space left between them, so as to define a middle gap 45 between them. And, the inner airflow path and the outer airflow path communicate with each other via the middle gap 45.

Figure 4:
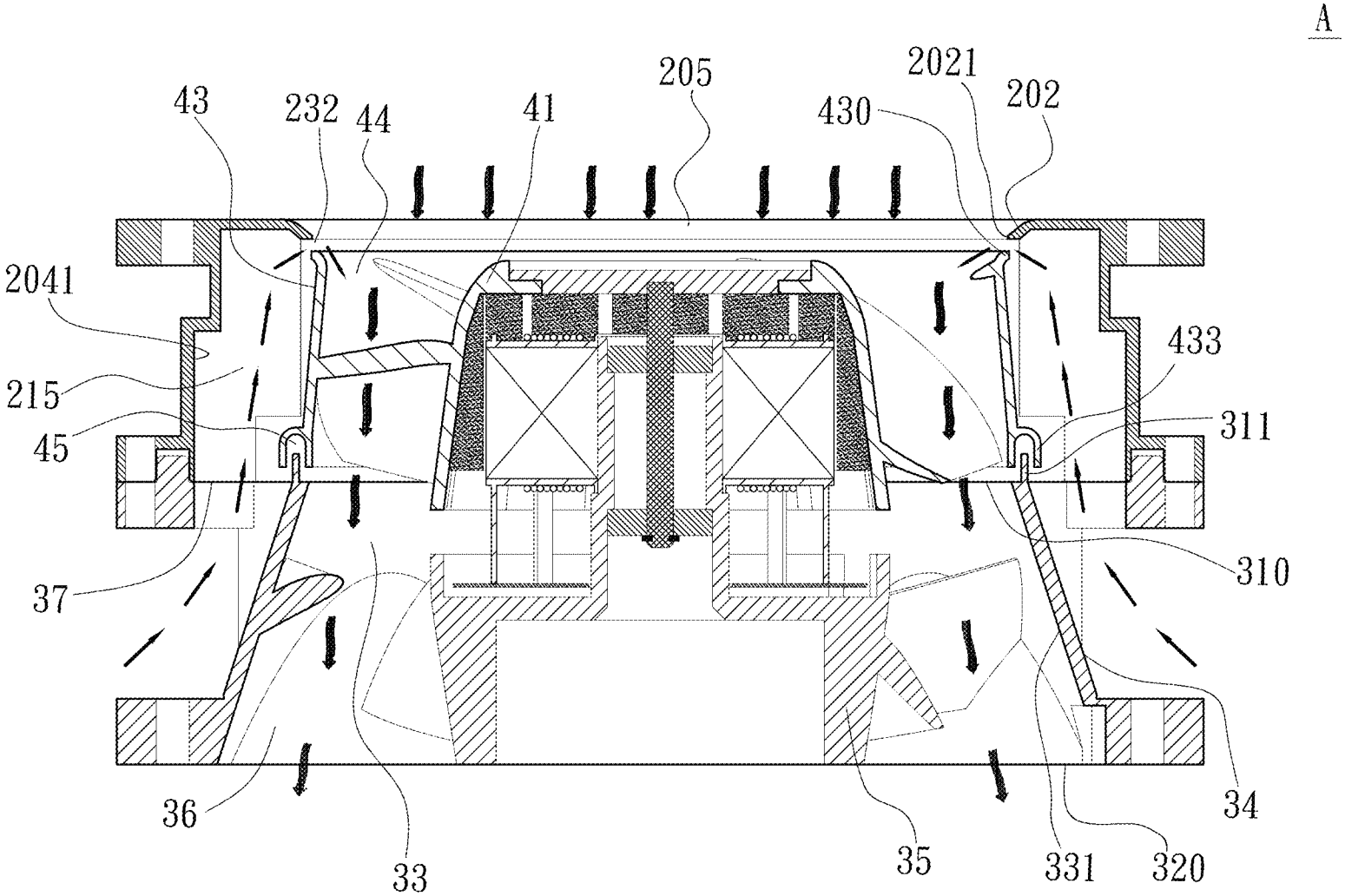
FIG. 4 is an assembled sectional side view of the fan structure of the present invention showing the same is operating in a free state.

Please refer to FIG. 4, which shows the annular impeller 40 rotates in a free state, or a backpressure free state. In this state, the air resistance or pressure the annular impeller 40 has to overcome during its operation is relatively small. When the annular impeller 40 rotates, external air over the upper frame 20 is guided through and sucked into the upper frame air inlet 205 and then enters the impeller air passage 44 and flows through the flared air passage 33 before leaving the fan structure A via the stationary-blade-frame outlet 320. That is, the air being sucked in is the main airflow that flows through the inner airflow path. Meanwhile, external air surrounding the stationary blade frame 30 flows into the outer airflow path along the inclined section 34 of the stationary blade frame 30 toward the upper frame 20; the air keeps flowing through the through bore 37 on the top portion 31 of the stationary blade frame 30 and the outer side passage 215 of the upper frame 20 to flow into the inner airflow path via the upper gap 232 to meet the main airflow. The combined surrounding airflow and main airflow flows from the upper frame 20 out of the fan structure A via the stationary-blade-frame outlet 320.

Figure 5:
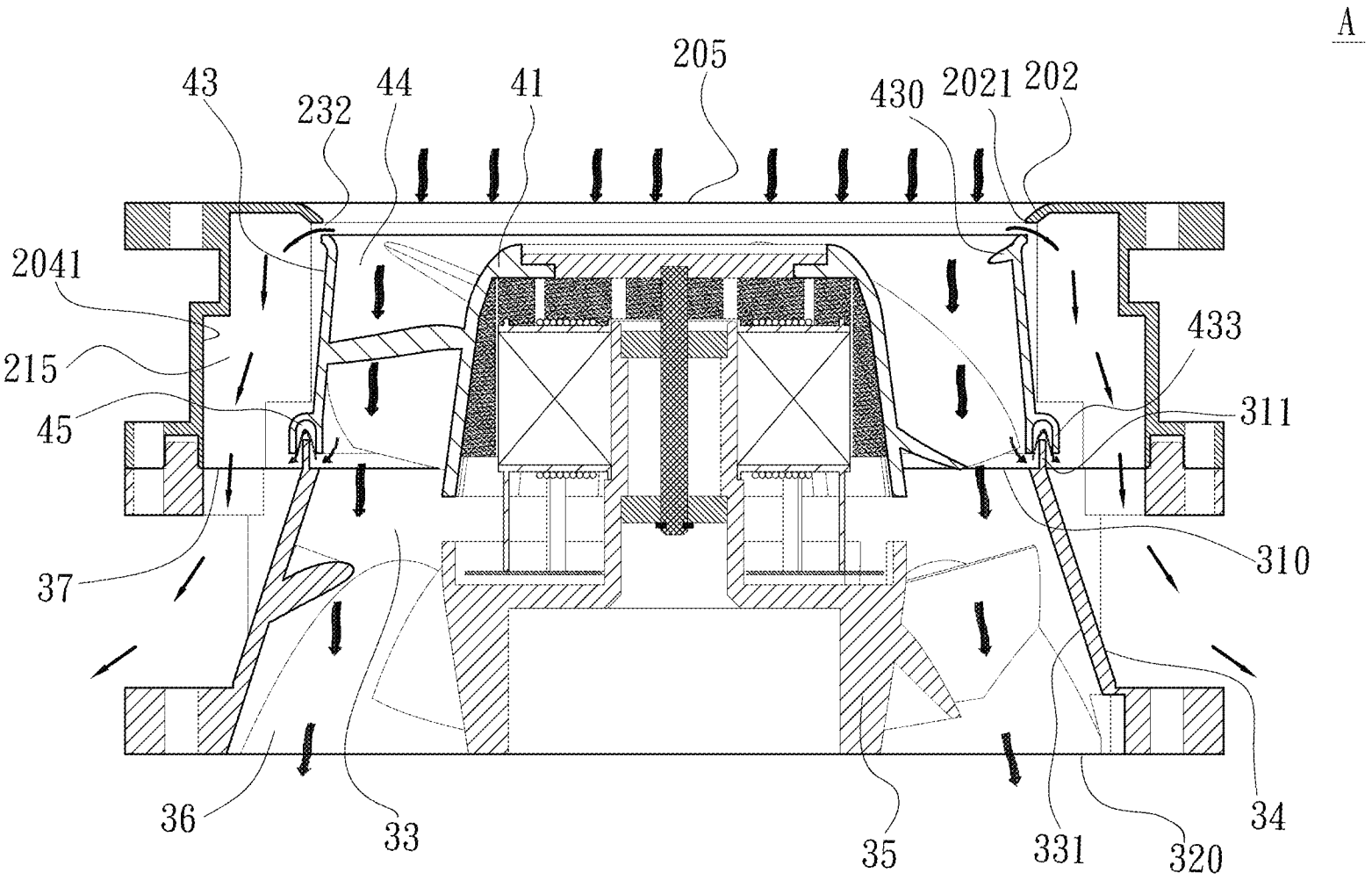
FIG. 5 is an assembled sectional side view of the fan structure of the present invention showing the same is operating in a backpressure increased state.

Please refer to FIG. 5, which shows the annular impeller 40 in a backpressure increased state. In this state, the air resistance or pressure the annular impeller 40 has to overcome during its operation is relatively large. In this case, the above-mentioned main airflow flows through the inner airflow path in the same direction as described in FIG. 4. However, a part of the air near a periphery of the upper-frame air inlet 205 does not enter the inner airflow path but is guided by the guide brim portion 202 to flow through the upper gap 232 and escape into the outer side passage 215. The escaped air flows through the through bore 37 on the top portion 31 of the stationary blade frame 30 and then flows along the inclined section 34 of the stationary blade frame 30 to leave the fan structure A into the external environment.

When the backpressure increases gradually, the middle gap 45 between the lower rim 431 of the annular member 43 and the upward flange 311 formed around the stationary-blade-frame inlet 310 can not be fully sealed, which leads to air leakage thereat. That is, a part of the air sucked and flowed into the inner airflow path leaks out via the non-sealed middle gap 45 into the outer airflow path. The airflow leaked via the middle gap 45 and the airflow escaped via the upper gap 232 combines in the outer airflow path to flow through the through bore 37 on the top portion 41 of the stationary blade frame 30 and then flows along the inclined section 34 to leave the fan structure A into the external environment. In this way, air would not gather in the fan to cause airflow disturbance to enable the effect of reduced noise.

Please refer to FIGS. 4 and 5 at the same time. When the backpressure increases gradually from zero to a certain degree, i.e. to an backpressure increased state, the main airflow in the inner airflow path has generally the same flowing direction, while the airflow in the outer airflow path has a flowing direction changed from that shown in FIG. 4 (in a free state) to that shown in FIG. 5 (in a backpressure increased state). With these design, the fan structure A of the present invention is suitable for use in different backpressure states from the backpressure-free state to the relatively high backpressure state.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A fan structure, comprising:

an upper frame having an upper-frame top portion, an upper-frame bottom portion, and an upper-frame wall portion internally defining a receiving space; and the upper-frame wall portion being provided on an inner side at positions corresponding to four corners of the upper-frame top portion with at least one recess, which is communicable with the receiving space;

a stationary blade frame being connected to a lower side of the upper frame and including a top portion, a bottom portion, a flared air passage, at least one inclined section, and a stator seat; the flared air passage being conical in shape and having a diametrical size increasing gradually from the top portion toward the bottom portion of the stationary blade frame and being enclosed in an air passage wall surface; each inclined section being radially inset from a respective one of four corners of the stationary blade frame corresponding to the four corners of the upper-frame top portion formed on the inner side of the upper-frame wall portion, and being radially outward and downward inclined from the top portion to the bottom portion of the stationary blade frame; the top portion of the stationary blade frame being connected to the upper-frame bottom portion end-to-end and having a stationary-blade-frame inlet and an upward flange extending around an outer periphery of the stationary-blade-frame inlet; and the stator seat being located in the flared air passage and having a shaft barrel provided thereon; and an annular impeller located in the receiving space of the upper frame and rotatably connected to the shaft barrel of the stationary blade frame and accordingly, mounted on the stator seat; the annular impeller including a hub having a plurality of blades spaced on a circumferential outer surface of the hub, and an annular member connected to radially outer ends of the blades; the annular member having a lower rim facing toward and spaced from the upward flange formed around the stationary-blade-frame inlet, such that a middle gap is defined between the lower rim of the annular member and the upward flange at the stationary-blade-frame inlet; the hub and the annular member together defining between them an impeller air passage, the impeller air passage and the flared air passage of the stationary blade frame being communicable with each other to form an inner airflow path; the impeller member having an outer circumferential surface facing toward and spaced from the inner side of the upper-frame wall portion, such that at least one outer side passage is defined between the annular member of the annular impeller and the at least one recess respectively of the upper frame; the at least one outer side passage being located in the receiving space outside the impeller air passage; the at least one outer side passage and the at least one inclined section of the stationary blade frame together forming a respective outer airflow path that leads to an external environment; the at least one outer airflow path being communicable with the inner airflow path via the middle gap.

2. The fan structure as claimed in claim 1, wherein the lower rim of the annular member is provided with a downward opened annular groove, which is configured corresponding to the upward flange around the inlet of the stationary blade frame for joining with each other loosely and forming the middle gap between them.

3. The fan structure as claimed in claim 1, wherein the annular member has an upper rim; the flared air passage of the stationary blade frame having a stationary-blade-frame inlet and a stationary-blade-frame outlet located at the top portion and the bottom portion of the stationary blade frame, respectively; the upper-frame top portion having an upper-frame air inlet located above the impeller air passage, and the upper-frame air inlet being formed along a periphery thereof with a sloping downward guide brim portion that extends radially inward toward the impeller, such that an upper gap is formed between a free end of the guide brim portion and the upper rim of the annular member; and the upper gap communicating with the upper-frame air inlet and the at least one outer side passage.

4. The fan structure as claimed in claim 1, wherein the upper frame is connected to the stationary blade frame by a way selected from the group consisting of fitting, locking, gluing, snapping and fastening.

5. The fan structure as claimed in claim 1, wherein the shaft barrel extends upward through the top portion of the stationary blade frame to project into the receiving space of the upper frame.

6. The fan structure as claimed in claim 1, wherein the top portion of the stationary blade frame has at least one through bore provided at a position corresponding to the at least one recess and the at least one inclined section, and the at least one outer airflow path extending to the at least one inclined section via the at least one through bore.

* * * * *